United States Patent [19]

Bauerfeind

[11] Patent Number: 4,730,532

[45] Date of Patent: Mar. 15, 1988

[54] ADD-ON DEVICE FOR A MUSICAL INSTRUMENT, PARTICULARLY A HIGH-HAT MACHINE

[76] Inventor: Karl R. Bauerfeind, Heideweg 3, D-8521 Langensendelbach, Fed. Rep. of Germany

[21] Appl. No.: 936,116

[22] Filed: Dec. 1, 1986

[30] Foreign Application Priority Data

Dec. 2, 1985 [DE] Fed. Rep. of Germany ... 8534176[U]

[51] Int. Cl.[4] ..... G10D 13/06

[52] U.S. Cl. ..... 84/422 R; 84/453

[58] Field of Search ..... 84/422, 453

[56] References Cited

U.S. PATENT DOCUMENTS

| | | | |
|---|---|---|---|
| 4,037,505 | 7/1977 | Maples | 84/280 C |
| 4,517,876 | 5/1985 | Duhon | 84/422 H |
| 4,528,888 | 7/1985 | Hoshino | 84/422 H |

FOREIGN PATENT DOCUMENTS

| | | | |
|---|---|---|---|
| 3000536 | 7/1981 | Fed. Rep. of Germany | 84/422 H |
| 590709 | 7/1947 | United Kingdom | 84/422 H |
| 1382432 | 1/1975 | United Kingdom | 84/422 H |

*Primary Examiner*—Lawrence R. Franklin

*Attorney, Agent, or Firm*—Erwin S. Teltscher

[57] ABSTRACT

An add-on device for a pedal-operated musical instrument, particularly a Hi-Hat machine having a main pedal operable between a normal position, and another position lower than the normal position for corresponding displacement of an elongated pulling rod along a longitudinal direction thereof, the main pedal being normally returnable from the lower position to the normal position, includes an elongated stationary member, a member movable with respect to the stationary elongated member, and adapted to operatively abut the main pedal, and a releasable blocking device which may be actuated so as to block relative movement between the members, thereby inhibiting a return movement of the main pedal from the lower position to the normal position.

5 Claims, 5 Drawing Figures

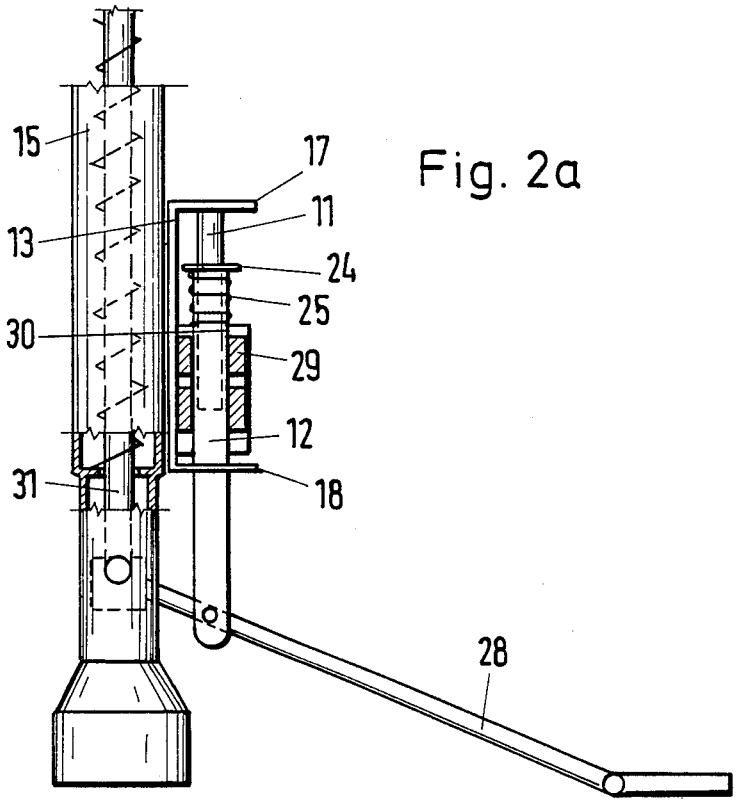
Fig. 2a
Fig. 2b
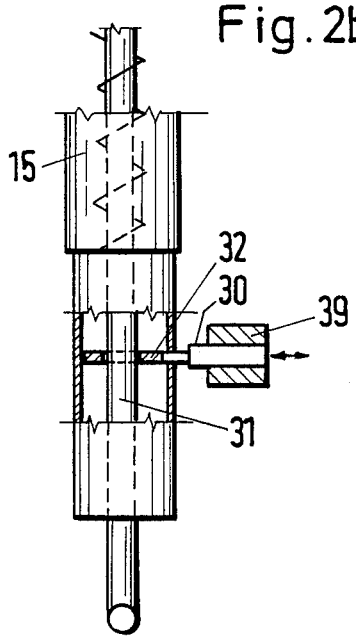
Fig. 2c
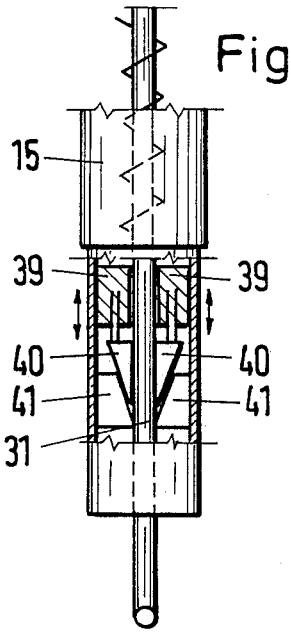

ADD-ON DEVICE FOR A MUSICAL INSTRUMENT, PARTICULARLY A HIGH-HAT MACHINE

The present invention relates to an add-on device for a musical instrument, particularly a musical instrument employing a pedal-operated cymbal or cymbals, such as a HI-HAT machine, where the cymbals are alternately clashed together by means of the pedal to produce a sharp ringing sound, and then again guided away from one another. A pedal-operated single cymbal instrument of this type is, for example, described and disclosed in U.S. Pat. No. 4,216,696 issued on Aug. 12, 1980 to Alexis Jr, while a HI-HAT machine makes use of two cymbals.

In a modern orchestra a player of such an instrument is, however, required to perform a variety of tasks, in which not only his hands, but also his feet are fully utilized. For this reason it is often not possible for the instrument-player to maintain the pedal of the HI-HAT machine for an extended period of time in the lower (closure) position by actuating the appropriate pedal, even though this mode of operation would often be desirable.

SUMMARY OF THE INVENTION

It is accordingly an object of the present invention to devise an add-on device for a musical instrument of the aforedescribed type, in which this desirable mode of operation is possible. This object is achieved in an instrument of this type which has a main pedal operable between a normal position, and another position lower than the normal position for corresponding displacement of an elongated pulling rod along a longitudinal direction thereof, the main pedal being normally returnable from the lower position to the normal position, which includes an elongated stationary member, a member movable with respect to the stationary elongated member, and adapted to operatively abut the main pedal, and releasable blocking means actuatable so as to block relative movement between the members, thereby inhibiting a return movement of the main pedal from the lower position to the normal position.

In one embodiment the stationary member extends along the longitudinal direction, and the movable member is movable with respect to the stationary member along the longitudinal direction, and further including yieldable means, such as a spring, in operative contact with the movable member for urging the movable member into an initial position near the stationary member.

In another embodiment the releasable blocking means includes formation of toothing means on the movable member, and a lever adapted to be pivotably mounted on the main pedal, and engageable with the toothing means.

In still another embodiment the releasable blocking means includes an apertured plate pivotably mounted on the elongated stationary member, the movable member passing through the apertured plate with small play. In this embodiment the releasable blocking means is movable between blocking and non-blocking positions, and includes a spring for releasably holding the apertured plate in the blocking position. Here the releasable blocking means is preferably releasably securable in either a force-locking or form-locking manner to the elongated stationary member by being pivotably moved thereto, and engaged therewith, and may be operable mechanically or electromagnetically. The releasable blocking means preferably includes an auxiliary pedal rigid with the movable member, disposed above the main pedal, and being adapted to inhibit movement of the main pedal in one direction.

In an alternate embodiment the releasable blocking means includes a ring adapted to normally surround the pulling rod with play, and drive means for displacing the ring in a direction transverse to the longitudinal direction of the pulling rod so as to eliminate the play, thereby inhibiting movement of the pulling rod due to contact friction between the pulling rod and the ring.

In yet another embodiment the pulling rod is formed with a longitudinal recess, and wherein the releasable blocking means includes a projection adapted to engage the longitudinal recess so as to limit movement of the pulling rod along one direction, upon the longitudinal recess formed in the pulling rod reaching a predetermined end region in a movement path thereof.

In still another embodiment the blocking means further includes a funnel-shaped member surrounding the pulling rod, and electro-magnetically actuatable wedge-shaped means engageable with the funnel-shaped member which, upon engagement therewith, inhibit further movement of the pulling rod.

BRIEF DESCRIPTION OF THE DRAWINGS

The invention will be better understood with the aid of the drawings, in which:

FIG. 2*a* is a partly sectioned elevation view of a first embodiment of an electromagnetically actuated version of the present invention;

FIG. 2*b* is a partly sectioned elevation view of a second embodiment of an electromagnetically actuated version of the present invention; and FIG. 2*c* is a partly sectioned elevation view of a third embodiment of an electromagnetically actuated version of the present invention.

DESCRIPTION OF THE PREFERRED EMBODIMENTS

Figure 1A:
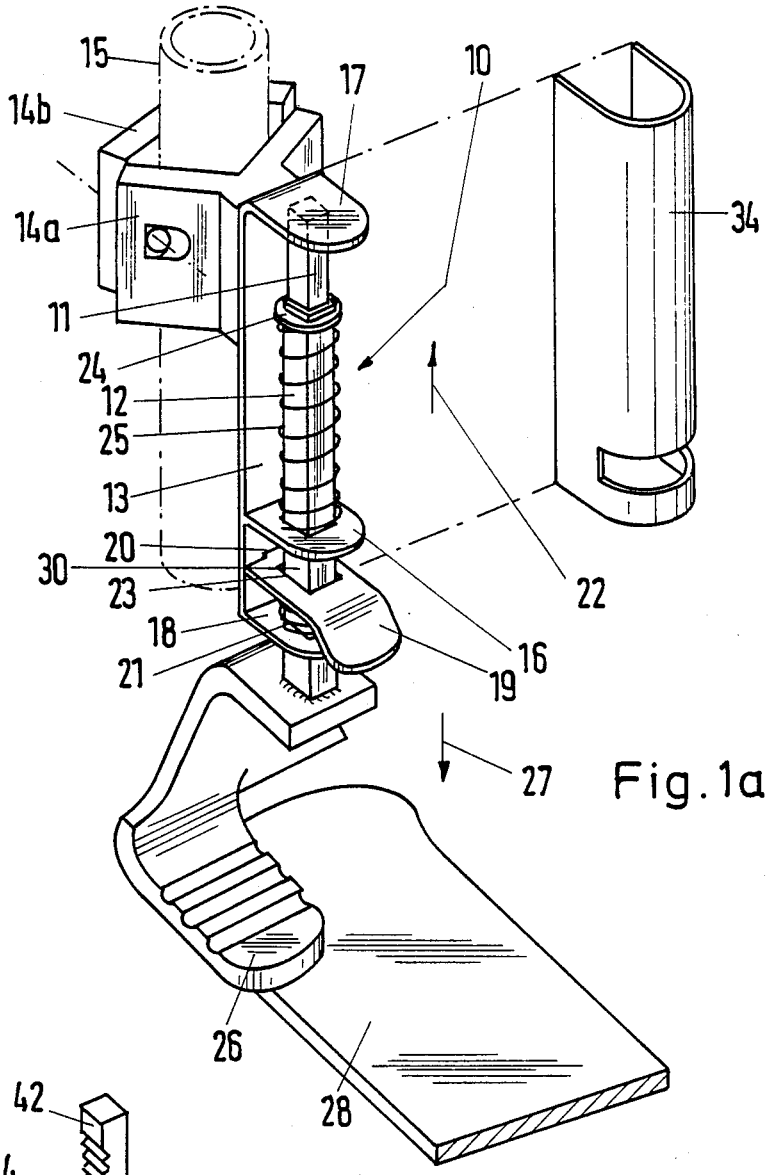
FIG. 1*a* is a perspective view of a first embodiment of a mechanically actuated version of the present invention.

Referring now to FIG. 1, the illustrated add-on device for a HI-HAT machine will be seen to include a stationary member 11 implemented as a guide post, and a movable member 12 slidably disposed on the stationary member 11, the stationary member 11 being held in bracket-shaped frame 13. The frame 13 is, in turn, mounted on a guidance post 15 of the HI-HAT machine via half shells 14*a* and 14*b*, known per se. The U-bracket-shaped frame 13 is additionally provided with a further guide member 16 for the movable part 12. Between the guide member 16 and a further leg 18 of the U-bracket-shaped frame 13, there is arranged an apertured plate 19, which is pivotable through a small angle or range only. A compression spring 21 disposed between the leg 18 of the frame 13, and between the aforesaid plate 19 urges the plate 19 to be maintained in a position slightly pivoted from a nonstressed position thereof, so that a displacement of the movable part 12 in a direction of the arrow 22 is prevented. The aperture 23 in the plate 19 allows only a small play with respect to the cross-section or profile of the movable member 12, and therefore blocks the movable member 12 from any movement in a pivoted position of the plate 12, despite the action of yieldably resilient means, such as a spring 24 disposed between the guide part 16, and a collar 25 of the movable member 12; hence the movable member 12 is held in any selected position thereof. It will be seen, therefore, that the apertured plate 19 in cooperation with the aforesaid compression spring 18 acts as releasable blocking means, the spring 25, in fact, reinforcing the blocking action of the apertured plate 19 on the movable member 12.

The inventive device permits a trouble-free movement of the movable member 12 in the direction of the arrow 27 by actuating a pedal 26, preferably rigidly connected to the movable member 12. A return movement of the movable member 12 in the direction of the arrow 22 is, however, prevented as a result of the entrainment of the apertured plate 19 in the direction of the arrow 22, and the resulting slight pivoting movement of the apertured plate 19, resulting in the aforementioned blocking action. The entire device therefore acts so as to limit unilateral movement of the movable member 12, but the effect of which can be cancelled at any time in a troublefree manner by actuating the apertured plate 19 in the direction of the arrow 27. As the pedal 26 projects at least partially into the movement path of a pedal known per se, namely that of the main pedal 28, it may, in turn, serve to limit movement of the main pedal 28 in one direction.

If it is desired to temporarily bring the HI-HAT machine into the closure position and maintain it thereat, it is only necessary to move the pedal 26, and therewith automatically also the pedal 28 downwardly by a foot movement in the direction of the arrow 27. In this lower position the pedal 26, and therewith the main pedal 28, is then automatically locked by the apertured plate 19. To release the pedal 28 from its locked position, a slight actuation of the apertured plate 19 by the foot in the direction of the arrow 27 is sufficient. In this manner the locking action of the apertured plate 19 is cancelled, and the movable member 12 moves again upwardly, being acted upon by the spring 25. In the upward position of the pedal 26, the main pedal 28 can again be actuated in the known manner. It is advantageous to arrange the cross-sections of the stationary member 11, and the movable member 12 surrounding the same to be non-circular, so as to prevent relative twisting or turning between these members.

Figure 1B:
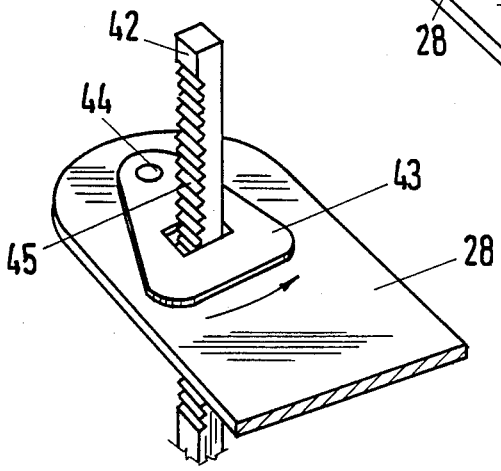
FIG. 1*b* is a perspective view of a second embodiment of a mechanically actuated version of the present invention.

Another version of a mechanically actuated releasable blocking means is illustrated in FIG. 1*b*, wherein a lever in the form of a triangularly shaped plate 43 is pivotably arranged on the main pedal 28. The plate 43, serving as a lever, can then be pivoted in such a manner about its pivot axis 44, that it becomes force-lockingly or form-lockingly engaged with toothing means 45 formed on a toothed rack 42 passing through the plate 43. The toothed rack 42, in turn, can include, or be part of the movable member 12. The pivotable plate 43 can be actuated by the instrument player, for example, by actuating it with the tip of his foot.

FIGS. 2*a*–2*c* show electro-magnetically actuated versions of the inventive device. For similar parts, the same reference numerals have been used as those illustrated in FIGS. 1*a* and 1*b*. In FIG. 2*a* it will be seen that an electromagnet 29 actuates the movable member 12, which may appropriately be made of any suitable ferromagnetic material. A pulling rod 31 is part of the conventional cymbal instrument, its interaction with a cymbal being set forth, for example, in the aformentioned Alexis Jr. reference. FIG. 2*a* shows an embodiment where the movable member 12 is, for example, articulatably connected with the main pedal 28.

A second version of an electro-magnetically actuatable device is shown in FIG. 2*b*. Here an electromagnet 39, or possibly an equivalent mechanically operated actuating device, actuates a horizontally displaceable ring 32, which normally surrounds, for example, the pulling rod 31 with play. Upon actuation of the electromagnet 39 for movement in a direction transverse to the longitudinal direction of the pulling rod 31, the ring 32 is made to abut the pulling rod 31 with sufficient friction to eliminate the play, and thus inhibit movement of the pulling rod along its longitudinal direction. The electromagnet 39 may be actuated, for example, by a (non-illustrated) manually operated, or foot-operated, pedal. In the embodiment shown it is advantageous to increase the diameter of the pulling rod 31, so as to reinforce the same. It will be understood that in lieu of a pulling ring 32, it would be equally possible to form the pulling rod 31 with a longitudinal recess, and replace the ring 32 with a projection slidable with respect to the electromagnet 39, for example slidable therewithin.

Another version of an electromagnetically actuated device, according to the present invention, is shown in FIG. 2*c*. Here the electromagnet 39 pushes, for example, wedge-shaped means, such as wedges 40, into a funnel-shaped member 41, which surrounds the pulling rod 31. Upon engagement of the wedges 40 with the funnel-shaped member 41, further movement of the pulling rod 31 is inhibited Depending on the polarity of the electromagnet 41, it is alternately possible for the wedges 40 to be lifted away from the funnel-shaped member 41, when the electromagnet 39 is actuated. In this latter embodiment the wedges 40 rest within the funnel-shaped member 41 solely by the action of gravity.

The surface 30 impacted on by the apertured plate 19 or by the electromagnets 29 or 39 may either be plane, so that the blocking or locking effect is solely achieved in a force-locking manner, or it may be additionally slightly corrugated or finely toothed. It will also be understood that an actuating electromagnet could also be used in lieu of the mechanical actuating means illustrated in FIGS. 1*a* and 1*b*.

The entire add-on device can, for esthetic reasons, be advantageously covered by a housing cover, such as the housing cover 34 illustrated in FIG. 1*a*.

In the examples described the add-on device has been illustrated as a separate device which is disposed external to the guide post 15 of the HI-HAT machine. It will be understood, of course, that by suitable dimensioning, the add-on device could also be situated within the HI-HAT machine.

The aforenoted add-on device permits a temporary releasable locking of the main pedal 28 in its lower, or closure position, while maintaining all other desired functions of the HI-HAT machine.

The foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as novel and desired to be protected by Letters Patent is set forth in the appended claims:

1. An Add-on device for a pedal-operated musical instrument, particularly a Hi-Hat machine having a main pedal operable between a normal position and another position lower than said normal position for corresponding displacement of an elongated pulling rod along a longitudinal direction thereof, said main pedal being normally returnable from said lower position to said normal position, comprising in combination an elongated stationary member, a member movable with respect to said stationary elongated member and including means adapted to operatively abut said main pedal to move said main pedal between said normal position and said lower position, releasably blocking means actuable so as to block relative movement between said members, thereby inhibiting a return movement of said main pedal from said lower position to said normal position, said releasable blocking means including an apertured plate pivotally mounted on said elongated stationary member so that said movable member passes through said apertured plate with small play, said apertured plate having an actuable portion and being movable between blocking and nonblocking positions, and a spring for releasably holding said apertured plate in said blocking position, so that by actuation of said abutting means with one foot a stepless blocking of the relative movement between said members is performed, then by pressing said actuable portion of said apertured plate with the same foot said blocking is automatically removed, and then by releasing said actuable portion said blocking is automatically performed in a new position.

2. The add-on device according to claim 1, wherein said stationary member extends along said longitudinal direction, and said movable member is movable with respect to said stationary member along said longitudinal direction, and further comprising yieldable means in operative contact with the movable member for urging said movable member into an initial position out of contact with said main pedal.

3. the add-on device according to claim 1, wherein one of said members fittingly surrounds the other member, and the cross-section of each of said members is non-circular so as to prevent a twisting movement between said member.

4. The add-on device according to claim 1, wherein said releasable blocking means is releasably accurable in a formlocking manner to said movable member by being pivotably moved thereto, and engaged therewith.

5. The add-on device according to claim 1, wherein said releasable blocking means includes an auxiliarry pedal rigidly connected to said movable member, disposed above said main pedal, and being adapetd to inhibit movement of said main pedal in one direction.

* * * * *